US011280520B2

(12) United States Patent
Miyajima

(10) Patent No.: US 11,280,520 B2
(45) Date of Patent: Mar. 22, 2022

(54) GAS HOT WATER SUPPLY

(71) Applicant: DENSO WAVE INCORPORATED, Aichi-pref. (JP)

(72) Inventor: Takahiro Miyajima, Chita-gun (JP)

(73) Assignee: DENSO WAVE INCORPORATED, Aichi-pref. (JP)

( * ) Notice: Subject to any disclaimer, the term of this patent is extended or adjusted under 35 U.S.C. 154(b) by 239 days.

(21) Appl. No.: 16/750,799

(22) Filed: Jan. 23, 2020

(65) Prior Publication Data

US 2020/0232678 A1 Jul. 23, 2020

(30) Foreign Application Priority Data

Jan. 23, 2019 (JP) ..... JP2019-009323
Jan. 17, 2020 (JP) ..... JP2020-006018

(51) Int. Cl.

| | |
|---|---|
| ***F24H 9/20*** | (2006.01) |
| ***F23N 1/02*** | (2006.01) |
| ***F23N 5/00*** | (2006.01) |
| ***F24H 1/18*** | (2022.01) |
| ***F23N 5/18*** | (2006.01) |

(52) U.S. Cl.

CPC ..... *F24H 9/2035* (2013.01); *F23N 1/025* (2013.01); *F23N 5/006* (2013.01); *F23N 5/187* (2013.01); *F24H 1/186* (2013.01); *F23N 2235/06* (2020.01); *F23N 2241/04* (2020.01); *F23N 2900/05005* (2013.01)

(58) Field of Classification Search

CPC ..... F24H 9/2035
See application file for complete search history.

(56) References Cited

U.S. PATENT DOCUMENTS

| | | | | |
|---|---|---|---|---|
| 5,997,278 | A * | 12/1999 | Sutton | F23N 3/082 431/12 |
| 2001/0003171 | A1* | 6/2001 | Sakamoto | G01K 1/02 702/187 |
| 2005/0133021 | A1* | 6/2005 | Kobayashi | F24H 8/006 126/350.1 |
| 2018/0128514 | A1* | 5/2018 | Knoeppel | C23F 13/06 |
| 2019/0203936 | A1* | 7/2019 | Hazzard | F23N 5/242 |
| 2020/0018721 | A1* | 1/2020 | Lego | G01N 27/407 |

FOREIGN PATENT DOCUMENTS

JP 2018-066540 A 4/2018

* cited by examiner

*Primary Examiner* — Nathaniel Herzfeld
(74) *Attorney, Agent, or Firm* — Oliff PLC

(57) ABSTRACT

In a gas hot water heater, changes of the signal output of an A/F sensor are calibrated in the atmosphere, in which the A/F sensor detects an oxygen concentration in a combustion tube. The gas supplied via a gas supply pipe is injected, together with in-taken air, into a combustion tube, which is incorporated in a hot water supply tank, via an injection unit. A proportional valve controls a combustion state in the combustion tube based on the detected oxygen concentration to thereby heat water supplied in the hot water supply tank. A purging process is performed to supply air into the combustion tube, at a timing between an extinguishment operation first performed after the ignition the gas mixture in the combustion tube and a re-ignition operation. Changes of signal output characteristics of the A/F sensor are subject to the calibration after the purging process.

4 Claims, 8 Drawing Sheets

GAS HOT WATER SUPPLY

CROSS-REFERENCE TO RELATED APPLICATION

This application is based on and claims the benefit of priority from earlier Japanese Patent Applications No. 2019-009323 filed on Jan. 23, 2019 and No. 2020-006018 filed on Jan. 17, 2020 the descriptions of which are incorporated herein by reference.

BACKGROUND

Technical Field

The present invention relates to a gas hot water heater having an A/F sensor (i.e., an air-fuel ratio sensor) for detecting an oxygen concentration.

Related Art

Various types of gas hot water heaters are known. For example, some gas hot water heaters mainly used in North America and the like are configured to supply gas to a combustion chamber via a Venturi tube. In this configuration, if the pressure difference between the inlet and outlet of the Venturi tube changes due to the atmospheric pressure or the like, a problem arises that the energy-saving performance of the gas hot water heater decreases due to a lowered combustion efficiency. JP 2018-66540 A discloses an exemplary gas hot water heater, in which a Venturi tube is used, although not in a gas supply system.

PRIOR ART REFERENCES

Patent Reference

[Patent reference 1] JP 2018-66540 A

SUMMARY OF THE INVENTION

Problems to be Solved by the Invention

Regarding the above issue, a technique has been proposed for optimizing the combustion efficiency by using a proportional valve in a gas supply system and controlling gas injection by use of an A/F sensor (an air-fuel ratio sensor) that detects an oxygen concentration. However, as shown in FIGS. 10A and 10B, the detection accuracy of the A/F sensor, which results in sensor output current characteristics, will deteriorate mainly due to the drift of linearity of the signal output caused by degradation over time. For example, although the initial detection characteristics of the A/F sensor which was shown by a solid line in FIG. 10A, various changes such as aging changes, time-dependent changes, changes of fuel combustion state, the detection characteristics may changes as shown by dotted lines in FIG. 10B. Therefore, the changes of detection characteristics of the A/F sensor are required to be calibrated in the atmosphere (that is, in the state where oxygen is supplied in the combustion tube).

Since water heaters continuously perform combustion to retain the temperature of hot water, the oxygen concentration in the combustion chamber is low. Therefore, it is difficult to calibrate the changes of detection characteristics of the A/F sensor in the atmosphere.

SUMMARY

It is thus desired to provide a gas hot water heater configured to calibrate shifts of the signal output of the A/F sensor, which are due to changes such as aging changes, with high accuracy in a configuration that an oxygen concentration in the combustion tube is detected by using an A/F sensor in an environment where it is continuously used.

According to a gas hot water heater in an exemplary embodiment, the gas supplied via the gas supply pipe, together with the intake air, is injected into the combustion tube, which is incorporated in the hot water supply tank, via the injection unit. The control unit controls the proportional valve provided on an end of the gas supply pipe, and controls a combustion state in the combustion tube on the basis of the oxygen concentration detected by the A/F sensor to thereby heat water supplied in the hot water supply tank. The control unit executes the purging process by which air is supplied into the combustion tube in a predetermined period of time ranging from a first extinguishment operation to a re-ignition operation after a gas mixture in the combustion tube has been ignited, and the sensor calibration unit calibrates (corrects) calibrates (corrects) changes of signal output characteristics, based on the detected oxygen concentration detected by the A/F sensor after the purging process is completed.

With this configuration, the sensor calibration unit can calibrate changes of the signal output characteristics (i.e., the detection characteristics) of the A/F sensor in a state in which oxygen is supplied in the combustion tube by the purging process (i.e., in the atmosphere). Accordingly, highly accurate calibration (or correction) can be performed.

Preferably, in the gas hot water heater, the current detection unit detects a current flowing in the A/F sensor. When a purging process starts, the sensor calibration unit starts detecting an oxygen concentration in the combustion tube on the basis of a current value detected by the current detection unit, and, when it is determined that the oxygen concentration is equal to or more than a threshold, the sensor calibration unit starts correction. Accordingly, the sensor calibration unit can perform correction with the oxygen concentration in the combustion tube being reliably increased.

Still preferably, in the gas hot water heater, if the oxygen concentration does not reach the threshold after a certain period of time has elapsed since the purging process starts, the sensor calibration unit instructs the control unit to extend an execution period of the purging process. Accordingly, the control unit can extend the execution period of insufficient purging process in response to the instruction from the sensor calibration unit.

Still, in a preferred embodiment, if the oxygen concentration becomes equal to or more than the threshold before a predetermined period of time has elapsed, the sensor calibration unit instructs the control unit to shorten an execution period of the purging process. Accordingly, the control unit can shorten the execution period of excessive purging process in response to the instruction from the sensor calibration unit.

DETAILED DESCRIPTION OF THE PREFERRED EMBODIMENTS

With reference to FIGS. 1 to 10, an embodiment will now be described.

Figure 1:
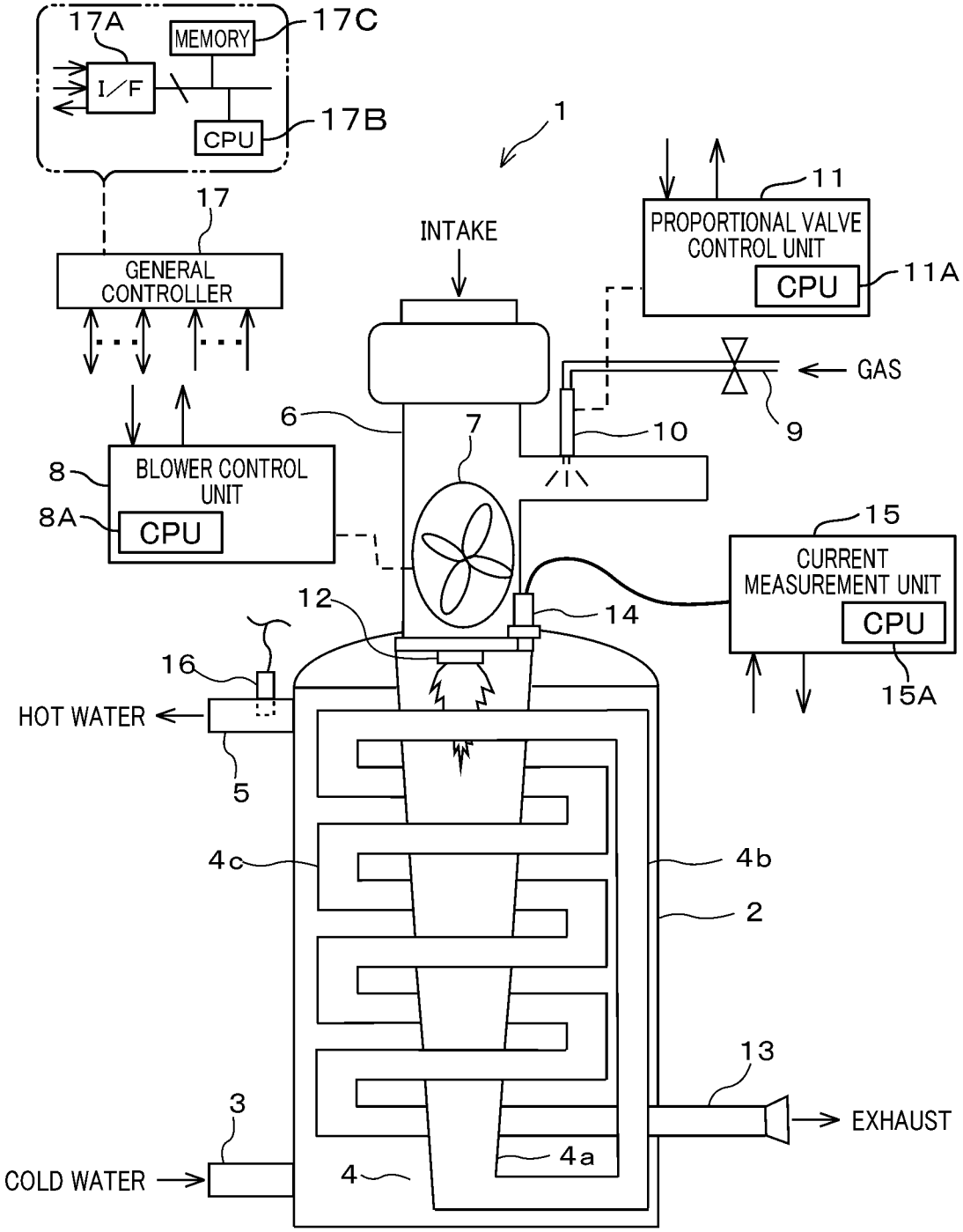
FIG. 1 is a diagram illustrating a configuration of a gas hot water heater of the present embodiment.

FIG. 1 is a diagram illustrating a configuration of a gas hot water heater 1 of the present embodiment. A hot water supply tank 2 is supplied with water from a tap, which is not shown, via a water supply pipe 3. The hot water supply tank 2 has a combustion tube 4 incorporated therein such that gas is burned in the combustion tube 4 to heat water into hot water. Hot water is fed out via an outlet pipe 5. A temperature sensor 16 for detecting the temperature of the hot water is arranged at the outlet pipe 5.

In addition, the gas hot water heater 1 is provide with a general controller 17 which controls later-described respective control units in an integrated manner. This general controller 17 is provided as a computer system including an interface 17A communicably connected to an internal bus, a CPU (central processing unit) 17B performing various calculation processes for integrated control (including combustion control including a purging process), and a memory unit 17C provided with a ROM (read-only memory) and a RAM (random access memory).

The CPU 17B reads into its work area various types of control programs previous stored in the memory unit 17C, and sequentially executes the respective steps of each of the programs. The work area can be provided in the memory unit 17C or in another memory which is different from the memory unit 17C. In the memory unit 17C, in addition to the foregoing programs, data necessary for the step-by-step execution in the CPU 17B are temporarily stored.

Incidentally, the CPU 17B adopted in the present embodiment will not be limited in its name to □CPU□ but can be replaced by an MPU, a processor, or circuitry called calculators.

An air intake pipe 6 is connected to the hot water supply tank 2. Further, a blower 7 is provided in the air intake pipe 6. The blower 7 is driven and controlled by a blower control unit 8 provided outside the air intake pipe 6, and takes in air from the outside. A gas supply pipe 9 is connected to an optional position in the air intake pipe 6 via a proportional valve 10. The proportional valve 10 is driven and controlled by a proportional valve control unit 11 provided outside the gas supply pipe 9. Thus, the amount of gas supplied to the air intake pipe 6 is regulated.

In the similar way to the configuration of the general controller 17, both the blower control unit 8 and the proportional valve control unit 11 are also configured to have CPU 8A and 11A, respectively.

A gas mixture of gas and air in the air intake pipe 6 is supplied to the combustion tube 4 via an injection unit 12. The gas mixture in the combustion tube 4 is ignited by an igniter, which is not shown, and burned. The combustion tube 4 is connected to the air intake pipe 6 in an upper part of the hot water supply tank 2 in the figure, and has a main part 4*a* extending downward in the hot water supply tank 2, a folded-back portion 4*b* extending from a lower part to an upper part of the hot water supply tank 2, and a spiral part 4*c* extending downward again therefrom while spirally surrounding the periphery of the main part 4*a*. The spiral part 4*c* is connected to an exhaust pipe 13 such that the gas after combustion is exhausted outside the hot water supply tank 2.

In the combustion tube 4, an A/F sensor (air-fuel ratio sensor) 14 is provided on the right side of the injection unit 12 in the figure. The A/F sensor 14 is connected to a current measurement unit 15 provided outside the hot water supply tank 2. Similarly to the configuration of the general controller 17, this current measurement unit 15 is provided with a computer system with a CPU 15A.

Figure 5:
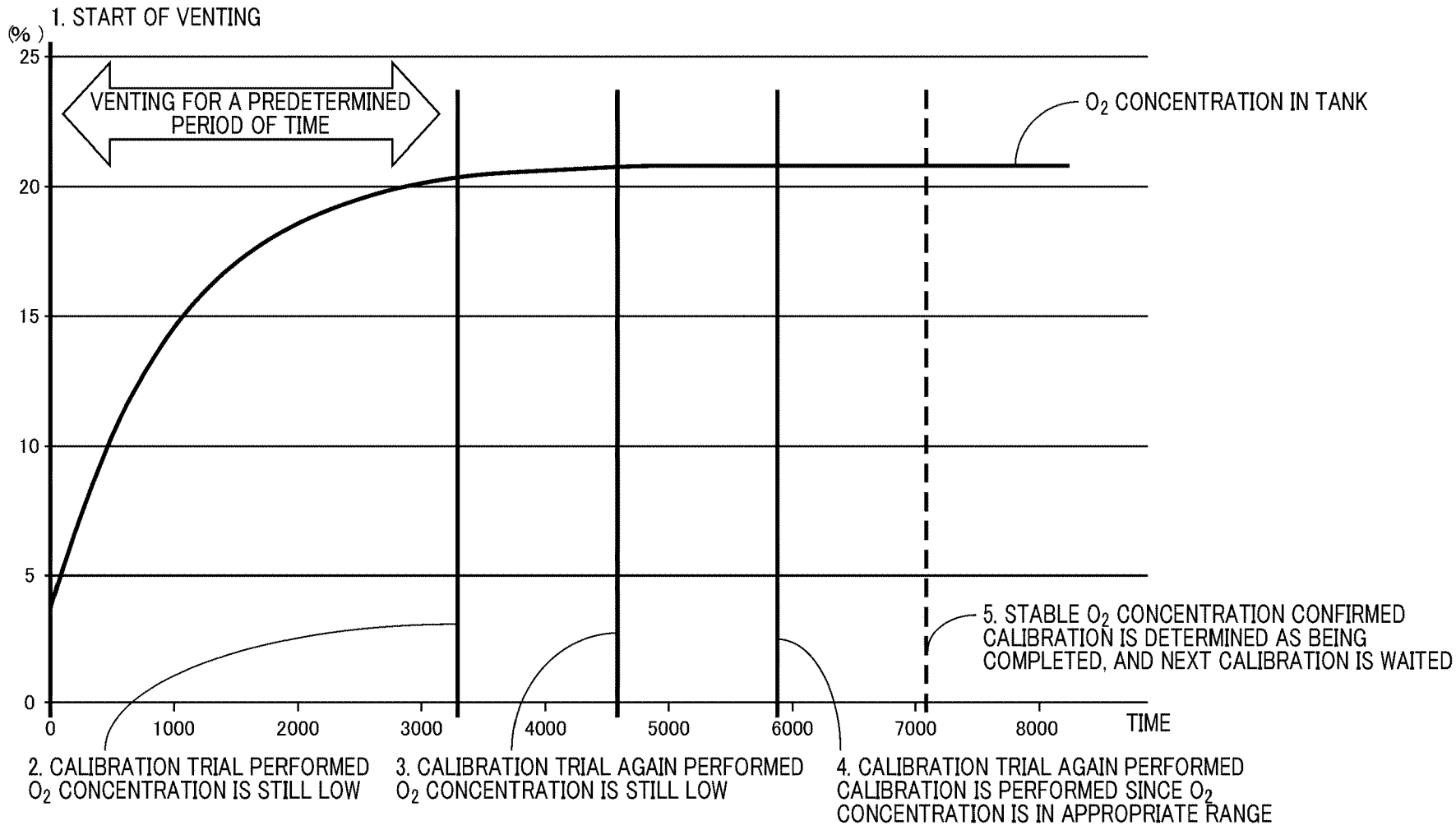
FIG. 5 is a diagram showing that an oxygen concentration in a combustion tube changes with execution of purging process.

As shown in FIG. 5, the current measurement unit 15, that is, the CPU 15A, measures a current value flowing through the A/F sensor 14 while driving the A/F sensor 14 to thereby determine an oxygen concentration in the combustion tube 4. Further, the current measurement unit 15, which corresponds to a control unit, also performs a process of calibrating (correcting) changes in the signal output characteristics of the A/F sensor 14. The current measurement unit 15 also functionally corresponds to a current detection unit.

The general controller 17, that is, the CPU 17B is communicable with, via an interface 17A, the blower control unit 8 (i.e., the CPU 8A), the proportional valve control unit 11 (i.e., the CPU 11A), and the current measurement unit 18 (i.e., the CPU 18A) so as to generally control such control units. A signal indicating the temperature detected by the temperature sensor 16 is fed to the general controller 17. Both the current measurement unit 15 and the general controller 17 functionally correspond to the sensor units. Information indicating the temperature detected by the temperature sensor 16 is fed to the general controller 17. Both the current measurement unit 15 and the general controller 17 functionally realize the sensor units.

The term □purging process□ as used herein refers to a process performed in a typical gas hot water heater, by which oxygen and air are introduced into a combustion chamber to prevent extinction due to incomplete combustion immediately after ignition to the gas.

With reference to FIGS. 2 to 9, operations of the present embodiment will now be described.

Figure 2:
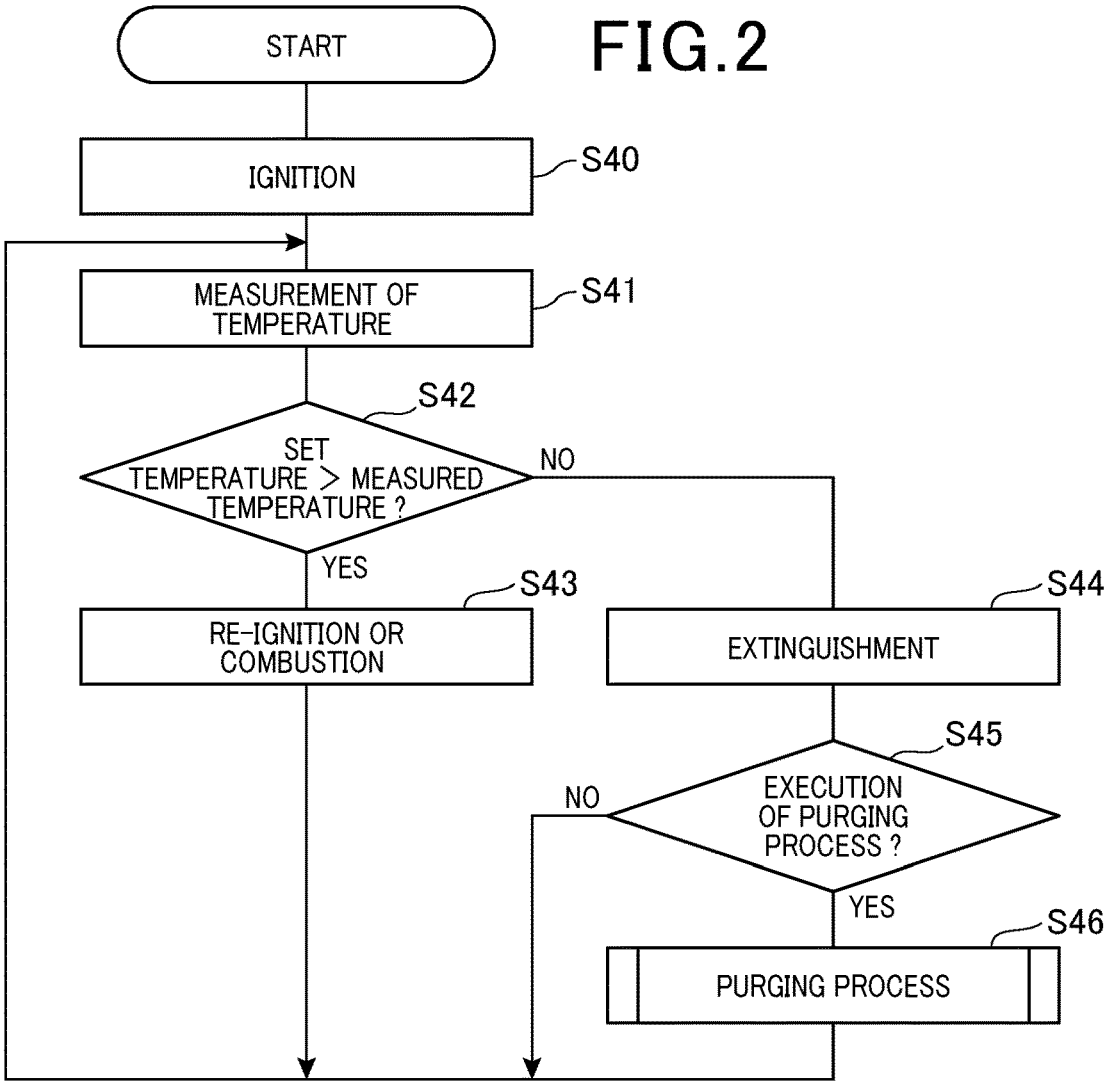
FIG. 2 is a flowchart mainly showing a purging process executed under the control of a general controller.

FIG. 2 is a flowchart showing combustion control performed by the general controller 17 accompanying the other control units. Namely, the combustion control accompanies control actions of the blower control unit 8, the proportional valve control unit 11, and the current measurement unit 18, as will be detailed later.

The general controller, which controls the overall system, allows the igniter to ignite the gas (step S40), and measures the temperature of water based on the signals from the temperature sensor 16 (step S41). Then, it is determined whether or not the measured temperature is less than a set temperature (step S42). If it is determined that the measured temperature is less than the set temperature (YES at step S42), the combustion is continued (step S43), while if it is determined that the measured temperature is equal to or higher than the set temperature (NO at step S42), the combustion is extinguished (step S44).

Then, it is determined whether or not conditions for performing the purging process are met (step S45). When the conditions are met (YES at step S45), the purging process is performed (step S46), whilst the conditions are not met (NO at step S45), the processing is returned to step S41. The conditions for performing the purging process are set as constant conditions or dynamically depending on specifications of each product and/or driving situations or environment of each product. By way of example, the conditions for performing the purging process can be a condition that the purging process should be carried out every time when the gas is extinguished.

When it is determined YES at step S42 which comes through performance of the step S44, the processing proceeds to step S43 where the igniter re-ignites the gas.

Figure 3:
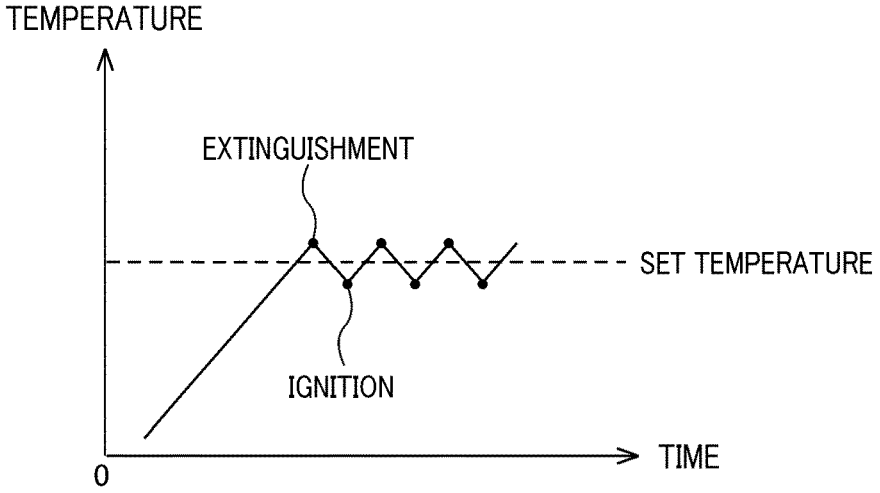
FIG. 3 is an illustration showing changes in the temperature of water, which are controlled by the process shown in FIG. 2.

In this control, the extinguishment and ignition of the gas are repeated by the igniter, the temperature of water in the hot water supply tank 2 can be controlled as shown in FIG. 3, in which the temperature curve changes up and down a preset temperature by the extinguishment and ignition operations.

In such a period of time in which the up/down changes in the temperature last, the purging process is started at a timing between the first extinguishment operation and the next ignition operation, and completed by the timing at which the next ignition is performed. In the foregoing temperature-changing period, the temperature sensor 16 is activated to measure the temperature of the hot water at an interval of 5 to 10 seconds, for instance, and the extinguishment and ignition are repeated at these intervals. Hence, the purging process can be performed in a state where a predetermined period of time corresponding to the foregoing periods has elapsed and the gas is already extinguished.

Figure 4:
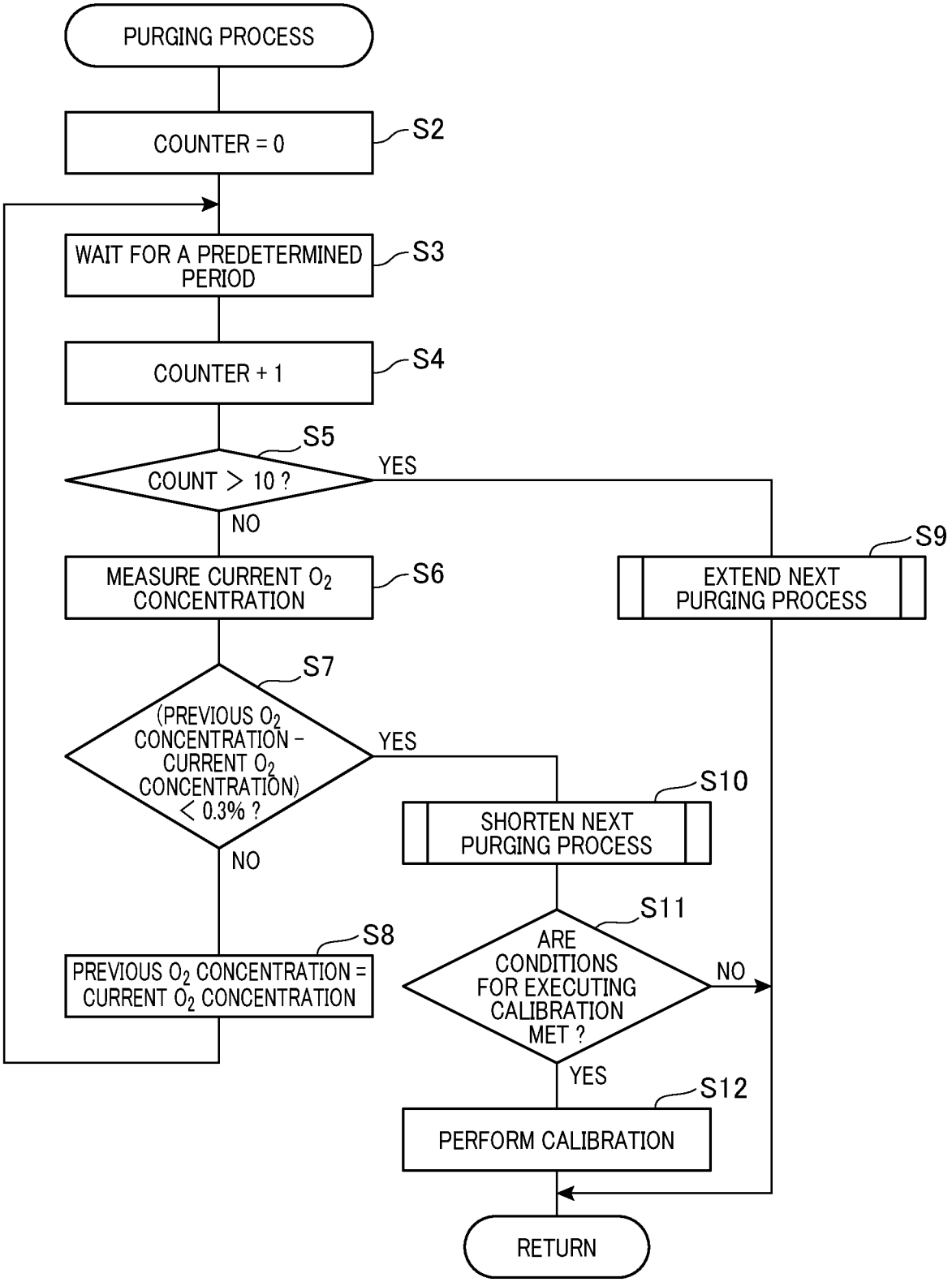
FIG. 4 is a flowchart mainly showing the purging process executed when calibration of an A/F sensor is performed.

FIG. 4 is a flowchart showing a purging process carried out at step S46 described above.

The current measurement unit 15 initializes a count of a counter provided for measuring a timing at which the purging process is performed (step S2). At this time, the proportional valve control unit 11 completely closes the proportional valve 10 to thereby stop the gas supply, and the blower control unit 8 drives the blower 7. Accordingly, only the air is supplied to the combustion tube 4 when a purging process starts. Subsequently, the process waits for a predetermined period of time, for example, several seconds to several tens of seconds (step S3).

After the predetermined period of time has elapsed, the counter is incremented (step S4), and it is determined whether the counter value has exceeded a threshold □ 0□ which is previously set as a constant value (step S5). When the counter value is not larger than the threshold 10 (step 5, NO), the value of current flowing in the A/F sensor 14 is detected to thereby measure an oxygen concentration in the combustion tube 4 (step S6). Then, it is determined whether a difference between the oxygen concentration previously measured and the oxygen concentration currently measured is smaller than a threshold, which is set at 0.3% (step S7). When the difference between these oxygen concentrations is not smaller than the threshold 0.3% (step S7, NO), the currently measured oxygen concentration is substituted for the previously measured oxygen concentration (step S8). Then, the process returns to step S3.

During execution of the loop of steps S3 to S8, the counter count may exceed the threshold 10 (step S5; YES). This indicates that the difference between the oxygen concentrations in the combustion tube 4 does not become equal to or larger than the threshold 0.3% after the purging process is executed for a predetermined period. Then, the current measurement unit 15 cooperates with the blower control unit 8 to extend the period of the next purging process (step S9). The details will be described later.

Further, during execution of the loop of steps S3 to S8, the difference between the oxygen concentrations may become smaller than the threshold 0.3% (step S7; YES). This indicates that the difference between the oxygen concentrations in the combustion tube 4 becomes smaller than the threshold 0.3% before the purging process of the predetermined period is completed. Then, the current measurement unit 15 shortens the period of the next purging process (step S10). The details will be described later.

It is then determined whether or not conditions for executing a calibration process (or correction process) are met (YES at step S11), the A/F sensor 14 is subjected to calibration (or correction) (step S12). The conditions for executing the calibration process also depend on specifications or other factors of the gas hot water heater. One example of such conditions can be a trigger event that the gas hot water heater 1 is first ignited by a user after the heater has not been used for a few days.

FIG. 5 shows that the oxygen concentration in the combustion tube 4 changes with the execution of the purging process. The horizontal axis represents the number of samples of the oxygen concentration, and the vertical axis represents the percentage of the oxygen concentration. The sampling interval is, for example, approximately 0.3 seconds. The sampling of the oxygen concentration is constantly performed in parallel with the purging process shown in FIG. 4.

Figure 6:
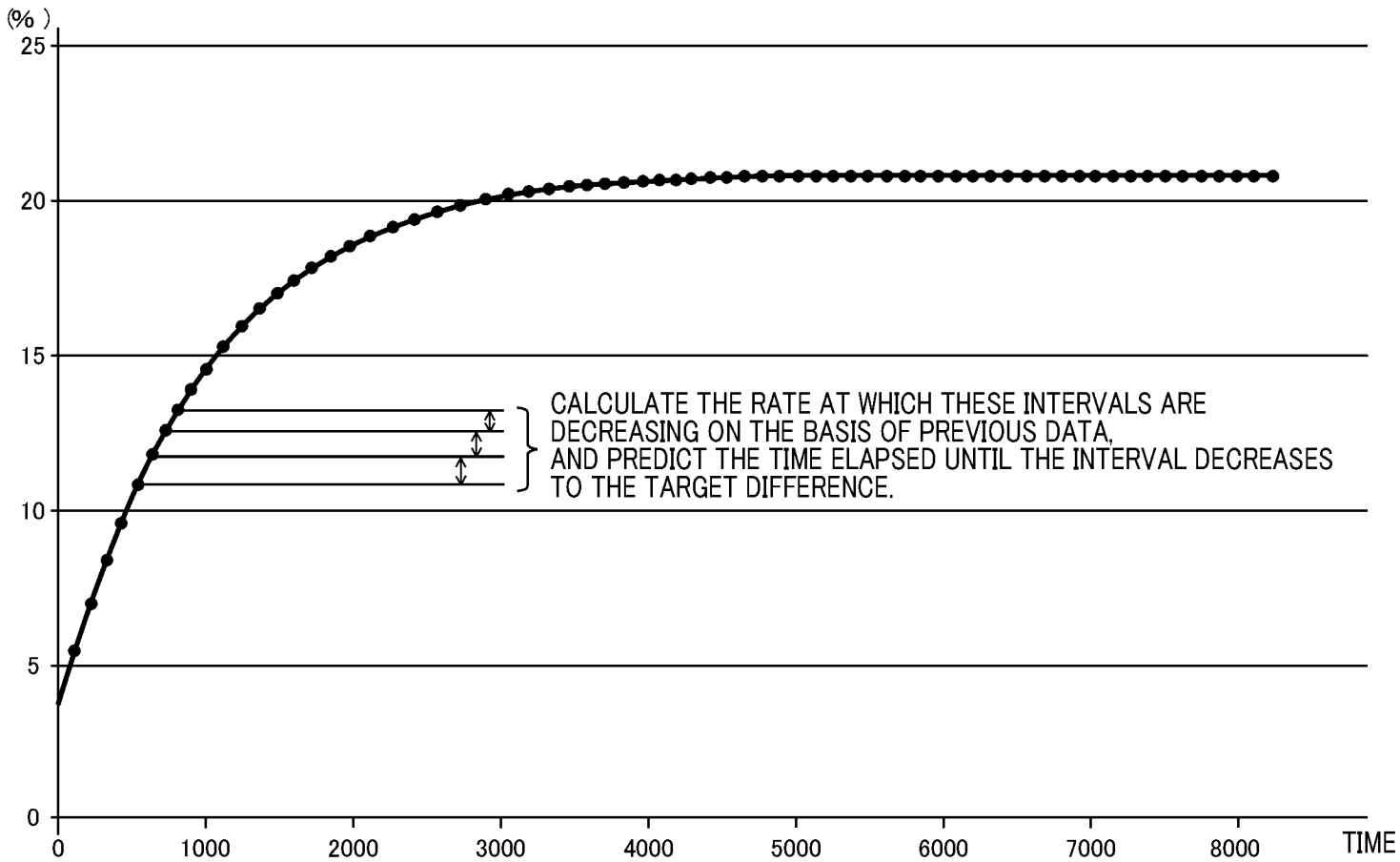
FIG. 6 is a diagram showing an example of determining an initial value of an execution period of the purging process.
Figure 7:
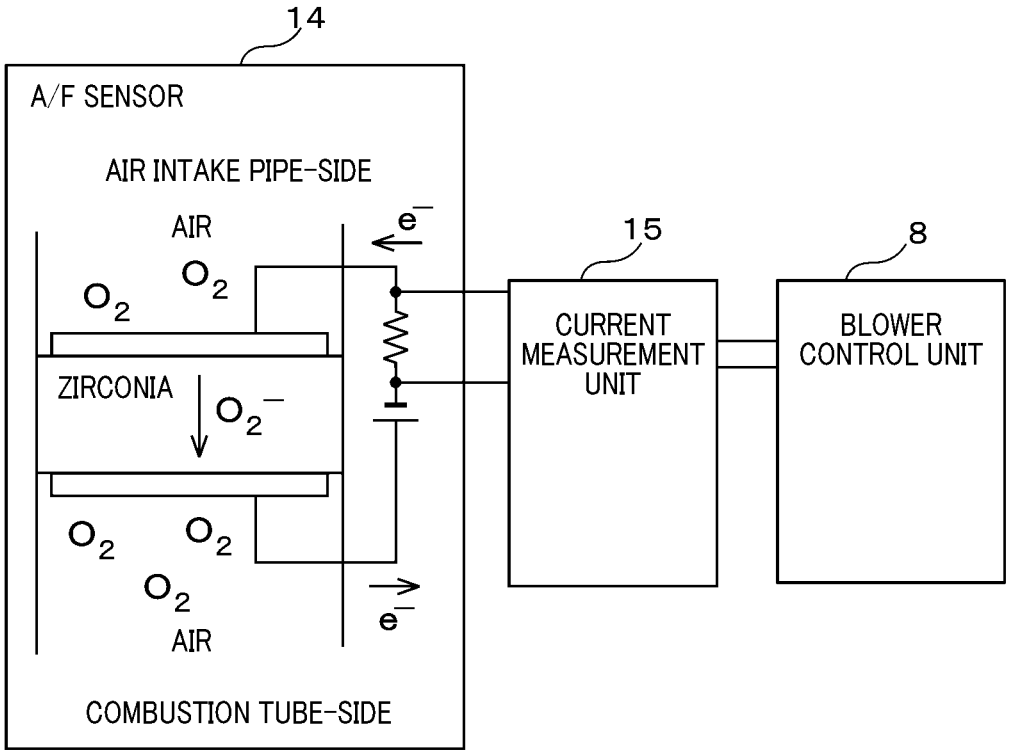
FIG. 7 is a diagram illustrating that calibration is performed when the oxygen concentrations on an air intake pipe-side and a combustion tube-side of the A/F sensor are equal.

FIG. 6 shows an example of determining the initial value of the execution period of the purging process. The initial value is determined depending on how long the purging process should be performed to make the difference in oxygen concentration sufficiently small on the basis of the change rate of concentration difference for the oxygen concentration samples that have been measured. FIG. 7 is a diagram illustrating that the calibration (or correction) is performed when the oxygen concentrations on the air intake pipe 6-side and the combustion tube 4-side of the A/F sensor 14 are equal.

Figure 8:
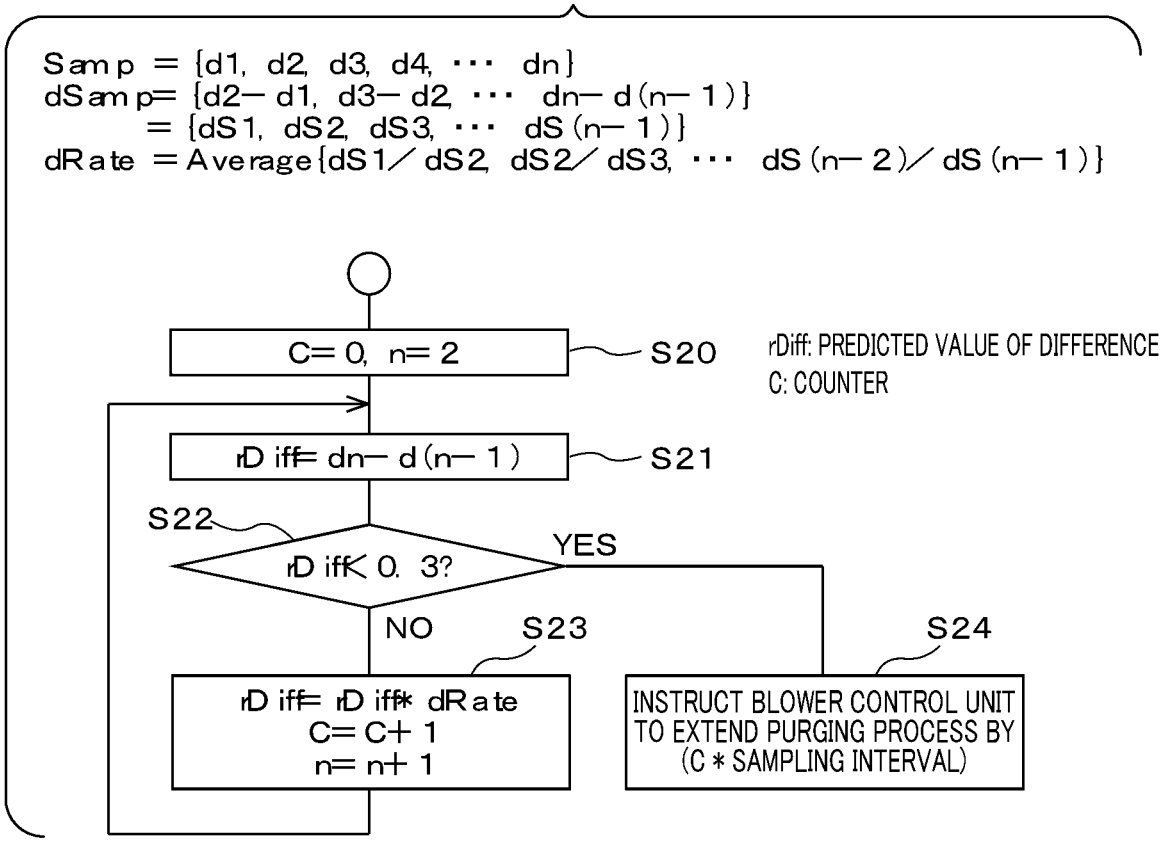
FIG. 8 is a flowchart showing the details of extension of the period of purging process.

FIG. 8 is a flowchart showing the details of extension of the period of purging process in step S9. By way of example, the samples of oxygen concentration that have been sampled before the execution of step S9 starts are defined as d1, d2, d3, □ dN, and the differences between the respective samples, dS1, dS2, □ d(N−1), are defined as $$dS1=d2-d1, dS2=d3-d2, \square, dS(N-1)=dN-d(N-1),$$

wherein N is a positive integer.

Further, dRate is defined as the average of $$dS1/dS2, dS2/dS3, \square dS(N-2)/dS(N-1).$$

In extension of the next purging process, in which the counter C=0 and n=2 (step S20), an expression of $$r\mathrm{Diff}=dn-d(n-1)$$

is obtained, where rDiff is the predicted value of the difference (step S21). Then, it is determined whether the predicted value rDiff is smaller than a threshold 0.3 (step S22). If the value is not smaller than the threshold 0.3 (NO at step S22), the predicted value rDiff is updated by an expression of $$rDiff = rDiff * dRate,$$

and the counter C, and n are each incremented (step S23). Then, the process returns to step S21.

If the predicted value rDiff becomes smaller than the threshold 0.3 (step S22; YES) during execution of the loop of steps S21 to S23, an instruction is notified to the blower control unit 8 to extend the period of purging process by a period obtained by multiplying the value of counter C at that time by the sampling interval (step S24).

Figure 9:
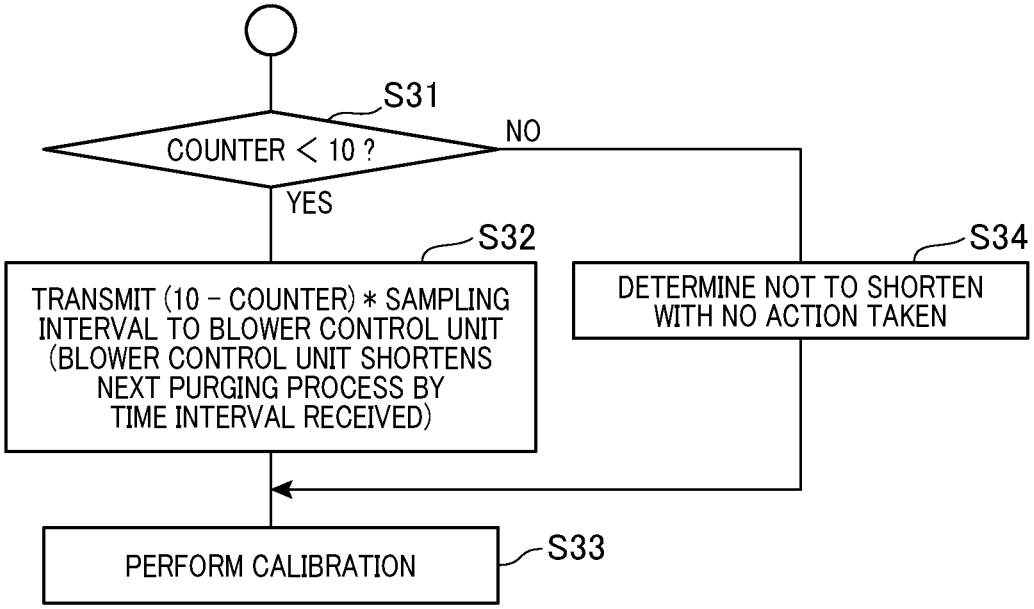
FIG. 9 is a flowchart showing the details of shortening of the period of purging process.

FIG. 9 is a flowchart showing the details of shortening of the period of purging process in step S10. First, it is determined whether the value of the counter at the time when the process proceed to step S10 is smaller than a threshold ❒ 0□ (step S31). If the value is smaller than the threshold ❒ 0□ (step S31, YES), a period obtained by multiplying a difference between the threshold ❒ 0□ and the count by the sampling interval is transmitted to the blower control unit 8 (step S32). Based on this, the blower control unit 8 shortens the execution period of the next purging process. Then, calibration of the A/F sensor 14 is performed (step S33). On the other hand, if the count is not smaller than the threshold ❒ 0□ in step S31 (NO), the execution period cannot be shortened (step S34), and the process proceeds to step S33.

As described above, according to the gas hot water heater 1 of the present embodiment, the gas supplied via the gas supply pipe 9, together with the intake air, is injected into the combustion tube 4, which is incorporated in the hot water supply tank 2, via the injection unit 12. The proportional valve control unit 11 controls the proportional valve 10 provided on an end of the gas supply pipe 9, and controls a combustion state in the combustion tube 4 on the basis of the oxygen concentration detected by the A/F sensor 14 to thereby heat water supplied in the hot water supply tank 2.

Further, the blower control unit 8 executes the purging process by which air is supplied into the combustion tube 4 in the period of time from an extinguishment control operation first performed after a gas mixture in the combustion tube 4 was ignited, to a re-ignition control operation, and the current measurement unit 15 performs calibration of changes of the signal output characteristics of the A/F sensor 14 after the purging process has been completed.

Figure 10A:
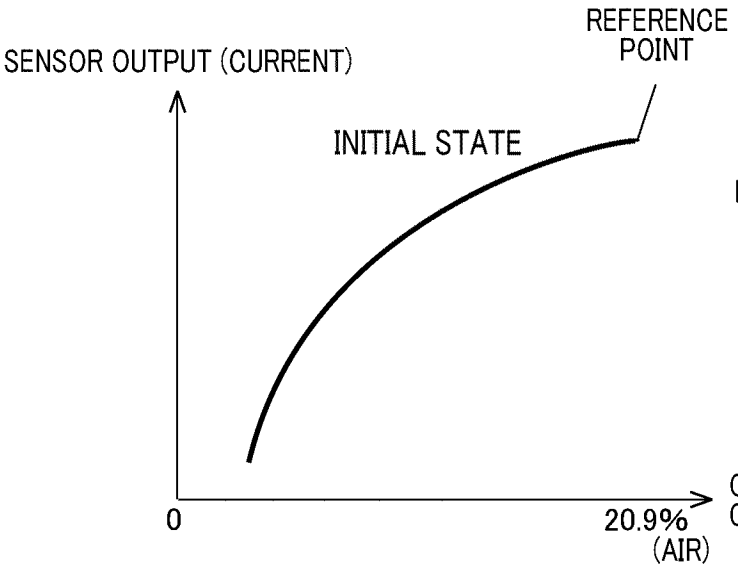
FIGS. 10A and 10B are diagrams showing shifts in the detection characteristics, which are due to aging.
Figure 10B:
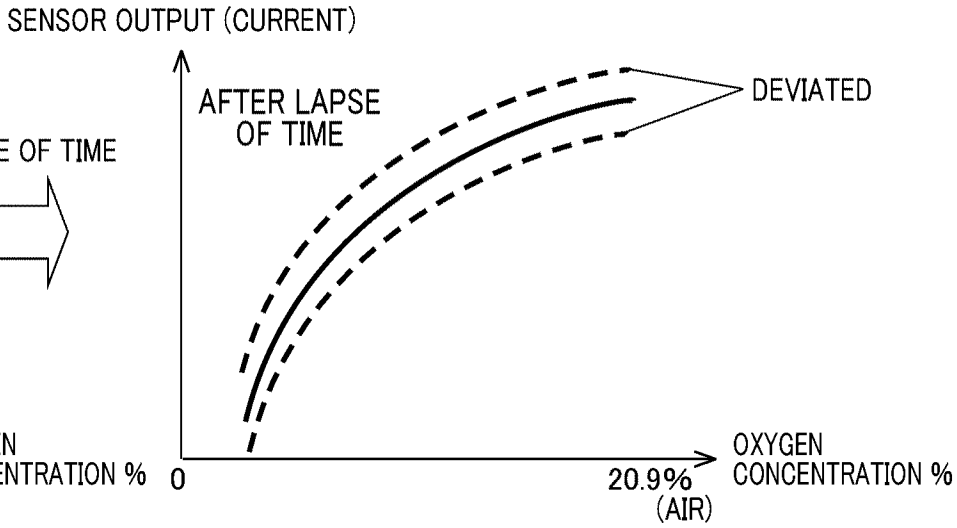

With this configuration, the current measurement unit 15 can calibrate (or correct) the changes of the detection characteristics of the A/F sensor 14 in a state where oxygen is present in the combustion tube by the purging process. Accordingly, highly accurate correction can be performed. Accordingly, it is possible to enable the calibration to be performed more reliably and with higher precision. Specifically, the detection characteristics of the A/F sensor 14, which has been provided as shown in FIG. 10A, can be prevented from being changed or deteriorated as shown in FIG. 10B due to its aging. In addition, executing the purging process according to the present embodiment allows the calibration process to be performed in a more efficient manner.

Further, the current measurement unit 15 detects a current flowing in the A/F sensor 14, and, when the purging process starts, starts detecting the oxygen concentration in the combustion tube 4 on the basis of the detected current value. When it is determined that the oxygen concentration is equal to or more than a threshold, the current measurement unit 15 starts calibration. Accordingly, the calibration can be performed with the oxygen concentration in the combustion tube 4 being reliably increased.

If the oxygen concentration does not reach a threshold after a certain period of time has elapsed since the purging process starts, the current measurement unit 15 instructs the blower control unit 8 to extend the execution period of the purging process. Accordingly, the blower control unit 8 can extend the execution period of insufficient purging process in response to the instruction from the current measurement unit 15.

Further, if the oxygen concentration becomes equal to or more than a threshold before a predetermined period of time has elapsed, the current measurement unit 15 instructs the blower control unit 8 to shorten the execution period of the purging process. Accordingly, the blower control unit 8 can shorten the execution period of excessive purging process in response to the instruction from the current measurement unit 15.

The present invention is not limited to the embodiments described above or shown in the drawings, and the following modifications or extensions are possible. The threshold of the oxygen concentration is not limited to a value 0.3%, and may be modified as appropriate according to the individual designs. The purging period may be extended or shortened as necessary.

Moreover, the one or more control and calculation functions provided by the foregoing blower control unit 8, proportional valve control unit 11, and current measurement unit 15 can be assigned to the general controller 17 or can be realized collectively by any one of such units.

DESCRIPTIONS OF PARTIAL REFERENCE NUMERALS

Throughout the drawings, 1 refers to a gas hot water heater, 2 refers to a hot water supply tank, 4 refers to a combustion tube, 6 refers to an air intake pipe, 8 refers to a blower control unit, 12 refers to an injection unit, 14 refers to an A/F sensor, and 15 refers to a current measurement unit.

What is claimed is:

1. A gas hot water heater comprising:

a hot water supply tank;

a combustion tube disposed in the hot water supply tank for burning gas;

an air intake pipe for taking in air;

a proportional valve for supplying gas which is supplied via a gas supply pipe to the air intake pipe;

an injection unit provided on an end of the air intake pipe, the injection unit being configured to inject a gas mixture of gas and air into the combustion tube;

an A/F sensor for detecting an oxygen concentration in the combustion tube;

a control unit that controls the proportional valve, and controls a combustion state in the combustion tube on a basis of the oxygen concentration detected by the A/F sensor to thereby heat water supplied in the hot water supply tank; and a sensor calibration unit calibrating changes of an output signal characteristic of the A/F sensor, wherein the control unit is configured to perform a purging process by which air is supplied to the combustion tube, the purging process being performed in a period of time from a first extinguishment operation of the gas mixture, which is performed after ignition of the gas mixture in the combustion tube, to a re-ignition operation of the gas mixture, and, the sensor calibration unit is configured to calibrate the output signal characteristic of the A/F sensor based on the oxygen concentration detected by the A/F sensor, after the purging process is completed.

2. The gas hot water heater according to claim 1, further comprising a current detection unit for detecting a current flowing in the A/F sensor, wherein, the sensor calibration unit is configured such that when the control unit starts a purging process, the sensor calibration unit starts detecting the oxygen concentration in the combustion tube on a basis of a current value detected by the current detection unit, and, when it is determined that the oxygen concentration is equal to or more than a threshold, the sensor calibration unit starts the correction.

3. The gas hot water heater according to claim 2, wherein, if the oxygen concentration does not reach the threshold after a predetermined period of time has elapsed since the purging process starts, the sensor calibration unit instructs the control unit to extend an execution period of the purging process.

4. The gas hot water heater according to claim 3, wherein, if the oxygen concentration becomes equal to or more than the threshold before the predetermined period of time has elapsed, the sensor calibration unit instructs the control unit to shorten the execution period of the purging process.

* * * * *